US007648423B2

(12) United States Patent
Levis, Jr.

(10) Patent No.: US 7,648,423 B2
(45) Date of Patent: Jan. 19, 2010

(54) GOLF SHOT SET-UP AND BALL PLACEMENT TRAINING DEVICE

(76) Inventor: Charles A. Levis, Jr., 12760 Island View Cir., Rogers, MN (US) 55374

( * ) Notice: Subject to any disclaimer, the term of this patent is extended or adjusted under 35 U.S.C. 154(b) by 0 days.

(21) Appl. No.: 12/108,848

(22) Filed: Apr. 24, 2008

(65) Prior Publication Data

US 2008/0268975 A1 Oct. 30, 2008

Related U.S. Application Data

(60) Provisional application No. 60/913,872, filed on Apr. 25, 2007.

(51) Int. Cl.
*A63B 69/36* (2006.01)

(52) U.S. Cl. ..... 473/218; 473/270

(58) Field of Classification Search ..... 473/218, 473/266, 270, 278, 409; 434/252
See application file for complete search history.

(56) References Cited

U.S. PATENT DOCUMENTS 4,000,905 A * 1/1977 Shirhall ..... 473/218
4,164,352 A * 8/1979 O'Brien ..... 473/218
4,355,810 A * 10/1982 Rydeck ..... 473/218
4,451,043 A 5/1984 Ogawa et al.
4,915,387 A * 4/1990 Baxstrom ..... 473/218
5,163,686 A * 11/1992 Bergman ..... 473/218
5,306,011 A * 4/1994 Perry ..... 473/218
6,592,376 B1 7/2003 Carpenter
7,144,339 B1 * 12/2006 Towsen ..... 473/409
2001/0036869 A1 11/2001 Grabowski
2003/0190972 A1 10/2003 Townsend, II
2005/0090323 A1 4/2005 Kellogg
2005/0090324 A1 4/2005 Cardosi
2005/0227774 A1 10/2005 Buck
2005/0239567 A1 10/2005 Elliott
2006/0194640 A1 * 8/2006 Pelz ..... 473/270
2007/0021227 A1 * 1/2007 Towsen ..... 473/218

OTHER PUBLICATIONS

PCT Search Report (mailed Aug. 26, 2008); 8 pgs.

* cited by examiner

*Primary Examiner*—Nini Legesse
(74) *Attorney, Agent, or Firm*—Dicke, Billig & Czaja, PLLC

(57) ABSTRACT

A golf teaching device including a cloth towel having a major surface on which indicia is printed and also including a rear foot position indicator, a plurality of lead foot position indicators, and first and second ball placement indicators. The plurality of lead foot position indicators includes spaced, first and second shot specific identifiers. The first shot specific identifier and the first ball placement indicator have an identical, first primary color, whereas the second shot specific identifier and the second ball placement indicator have an identical, second primary color. The first and second primary colors are different from one another. With this configuration, a user of the device quickly and easily confirm proper foot and golf ball placement in performing a desired golf shot.

19 Claims, 2 Drawing Sheets

GOLF SHOT SET-UP AND BALL PLACEMENT TRAINING DEVICE

CROSS-REFERENCE TO RELATED APPLICATIONS

This application claims priority under 35 U.S.C. §119(e)(1) to U.S. Provisional Patent Application Ser. No. 60/913,872, filed Apr. 25, 2007, entitled "Golf Shot Set-Up and Ball Placement Training Device"; the entire teachings of which are incorporated herein by reference.

BACKGROUND

The present disclosure relates to golf teaching devices. More particularly, it relates to portable, simple teaching aides for identifying user foot placement and/or ball placement in performing a variety of different golf shots.

Golf is an immensely popular sport, enjoyed by countless people worldwide. While most golfers profess to play simply for fun, virtually all participants, from beginners to experts, are constantly seeking to improve their game. To this end, the sport's basic equipment (e.g., clubs, balls, shoes, etc.) can play an important role in lowering a golfer's score; in fact, it is commonplace for an avid golfer to annually purchase the most recently devised equipment offerings. However, the golf swing itself is the primary source of improved play. The numerous variables associated with the fundamental golf swing render it an exceedingly difficult athletic endeavor to master, especially for beginning golfers and those of intermediate skill.

In light of the above, golfers invest countless hours practicing their swing. The assistance of a teaching professional is an invaluable resource in achieving swing improvement. As might be expected, however, advice given by a golf instructor may be forgotten or inaccurately recalled when the student later practices or plays. This is fairly common problem for less experienced golfers whom are otherwise attempting to remember and practice a fairly large number of golf swing skill sub-sets (e.g., club selection, grip, stance, ball placement, swing path, weight distribution and shift, etc.).

To purportedly facilitate a golfer's ability to "learn" the proper golf swing outside of the presence of a personal instructor, a plethora of different golf teaching aides have been devised. Many are mechanical in nature, worn or otherwise attached to the golfer's body; while potentially helpful, these mechanisms are expensive, can be uncomfortable at best to use, and do not provide the user with any visual clues that can be applied when the device is removed.

An alternative golf instructional aide takes the basic form of a mat and presents printed words, numbers and/or pictures or drawings. The user is instructed to stand on or near the mat, with the printed indicia advising the user on a number of the different golf swing topics, including club selection, ball placement, foot placement, target path, swing path, hand path, etc., to name but a few. Examples of mat-type golf instructional aides are provided in U.S. Pat. Nos. 5,306,111; 5,645,494; 6,482,102; 7,131,910; 7,144,339; and 7,186,184. While beneficial, these and other golf teaching mats have the marked drawback of being too complicated for many golfers, especially beginners. That is to say, in an effort to address as many swing components as possible, most available instructional mats are characterized by numerous words, numbers, pictures, arrows, and grid patterns that, taken in combination, are difficult, at best, for a user to readily comprehend. Further, where numerous shot or club strategies are being addressed by a single teaching mat (e.g., the mat instructions can describe or illustrate different stances, swing paths, ball placements, etc., for short iron shots, long iron shots, drives, and putts), it is virtually impossible for the user to quickly discern the desired correlation between the disparate instructional indicia.

An additional drawback associated with conventional mat-type golf swing teaching aides is that while normally portable, they are essentially useless apart from a practice scenario. For example, many golf teaching mats are formed of a somewhat flexible material, and so can be rolled up when not being used. When the user wants to practice his/her golf swing, the user takes the rolled mat with them to the practice location (e.g., a driving range) and then un-rolls the mat. However, even in rolled form, conventional golf teaching mats are still relatively bulky, and so cannot be conveniently carried by the user, such as with the user's golf bag.

In light of the above, a need exists for a golf teaching device that is highly portable, and provides basic, visually correlated instructional information in a relatively minimalistic format.

SUMMARY

Some aspects in accordance with principles of the present disclosure relate to a golf teaching device including a cloth towel having a major surface on which indicia is printed. In this regard, the indicia includes a rear foot position indicator, a plurality of lead foot position indicators, and first and second ball placement indicators. The rear foot position indicator is adapted to indicate a proper position and orientation of a user's rear foot. Each of the lead foot position indicators are adapted to indicate a proper position and orientation of a user's lead foot in performing one of a plurality of different golf shots. In this regard, the plurality of lead foot position indicators includes spaced, first and second shot specific identifiers. The first and second ball placement indicators are adapted to indicate a proper location of a golf ball to be struck by a user. In this regard, the first shot specific identifier and the first ball placement indicator have an identical, first primary color, whereas the second shot specific identifier and the second ball placement indicator have an identical, second primary color. The first and second primary colors are different from one another. With this configuration, a user of the device can quickly and easily confirm proper foot and golf ball placement in performing a desired golf shot. In some embodiments, the indicia further includes third and fourth shot specific identifiers, along with corresponding, third and fourth ball placement indicators correlated with one another, respectively, via a primary color differing from the primary colors of the other identifiers and indicators. The teaching device can be configured to provide instructions for various golf shots such as chips, putts, irons, pitch, drives, etc.

Other aspects in accordance with principles of the present disclosure relate to a method of aiding a golfer in preparing to perform a golf swing. The method includes providing a golf teaching device as described above. One of the plurality of lead foot position indicators is selected as corresponding with a golf shot desired by the golfer. The golfer visually matches the selected lead foot position indicator with the corresponding ball placement indicator based on color. A golf ball is placed adjacent the matched ball placement indicator. A rear foot of the golfer is placed on the rear foot position indicator. Finally, a lead foot of the golfer is placed on the shot specific identifier of the selected lead foot position indicator. With the golfer now in a proper stance position, the golf swing can be performed.

DETAILED DESCRIPTION

Figure 1:
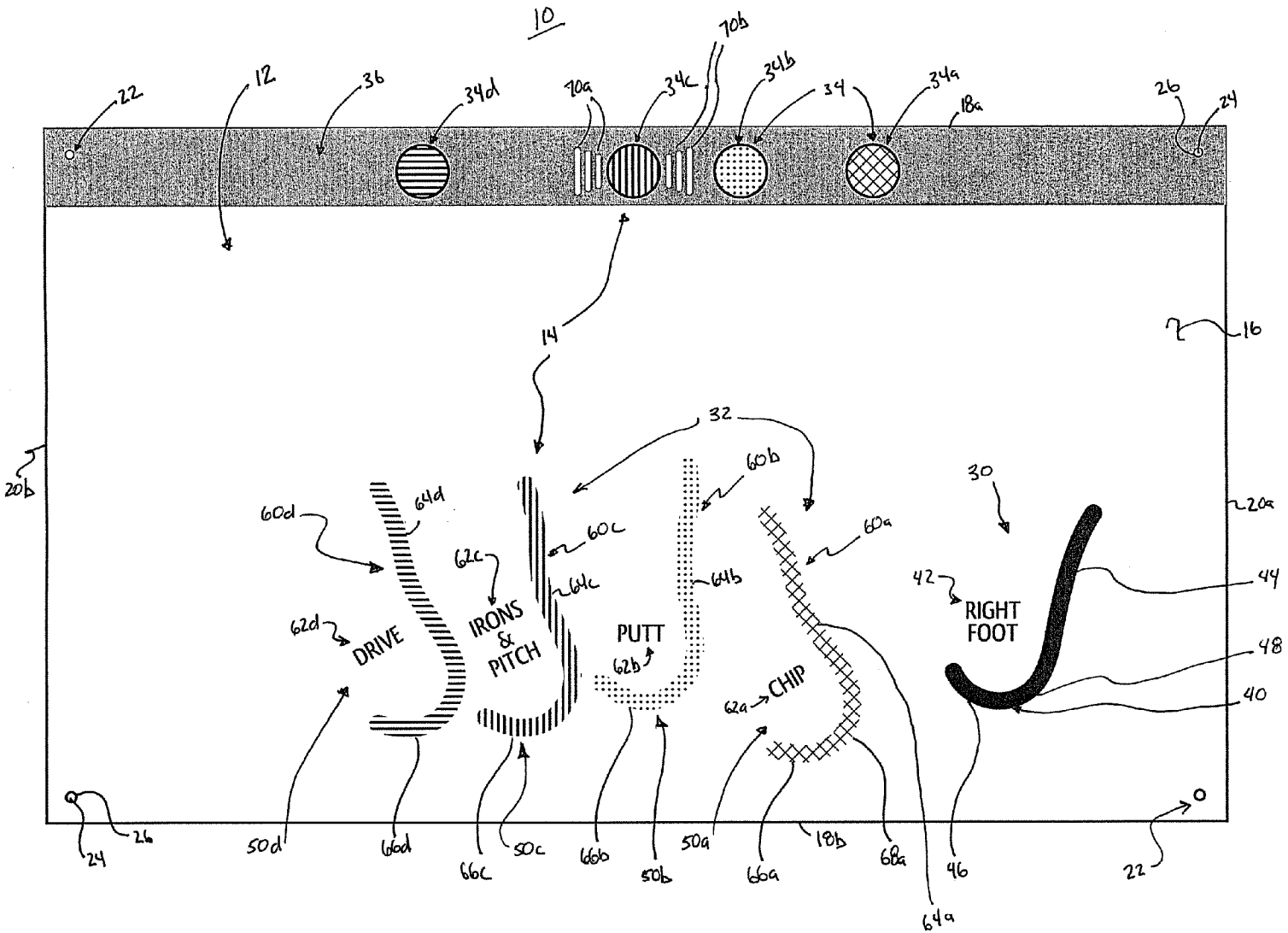
FIG. 1 is a top view of a golf shot set-up and ball placement training device in accordance with principles of the present disclosure.

One embodiment of a golf shot set-up and ball placement training device 10 in accordance with principles of the present disclosure is shown in FIG. 1. As a point of reference, the trailing device 10 is identical in the views of FIGS. 1 and 2, except that element numbering is removed in FIG. 2 to more clearly illustrate various features. The training or teaching device 10 includes a flexible base 12 and printed indicia 14 (referenced generally). Details on the various components are provided below. In general terms, however, the printed indicia 14 is formed on a major surface 16 of the base 12 and conveys golf shot set-up related instructions for one, two, or more different golf shots in a color coordinated fashion so that a user (not shown) can readily identify which portions of the indicia 14 correlate with one another in performing a particular golf shot.

The flexible base 12 can assume a wide variety of forms, but in some embodiments is a cloth towel. Other materials, such as woven or nonwoven materials, are also acceptable. With the one construction in which the flexible base 12 is a cloth towel, however, the teaching device 10 can be used for non-golf swing practice applications, such as a conventional golf towel otherwise carried by the user with his or her golf bag. As such, the teaching device 10 can further include a clip (not shown) or similar device useful for attaching the base/towel 12 to a golf bag as is known in the art. Regardless, the flexible nature of the base 12 renders the teaching device 10 highly portable.

The base 12 can have a variety of different sizes, and in some embodiments has a generally rectangular shape defined by opposing sides 18*a*, 18*b*, and opposing ends 20*a*, 20*b*. For example, the base 12 can have a length (i.e., dimension of the sides 18*a*, 18*b*) on the order of 16-36 inches and a width (i.e., dimension of the ends 20*a*, 20*b*) on the order of 10-24 inches, although other dimensions are also acceptable. Thus, for example, the base 12 can have a first size appropriate for an adult user, and a second, smaller size for an adolescent user.

Figure 2:
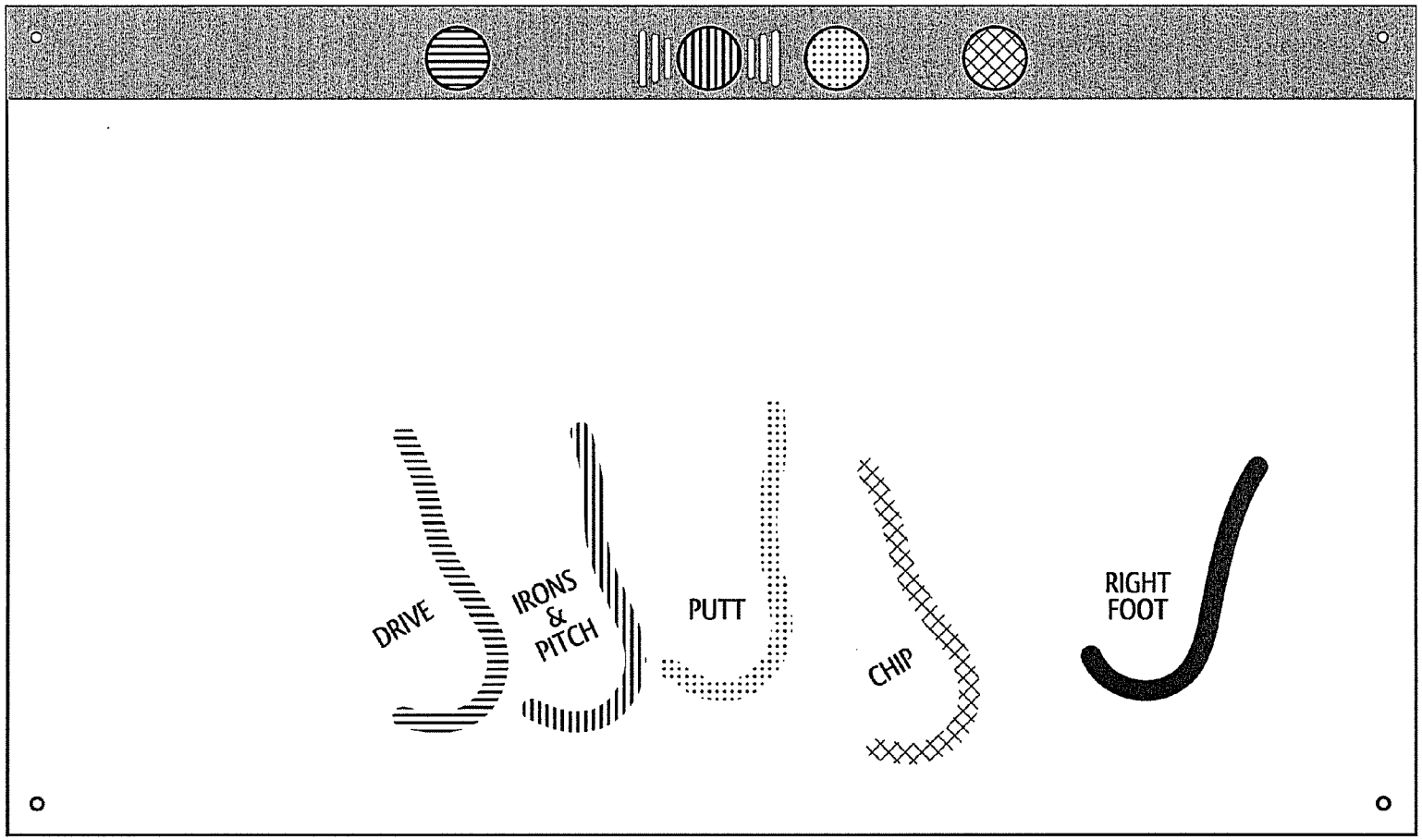
FIG. 2 is a duplicate view of the training device of FIG. 1 with element numbers removed to better illustrate features of the pending disclosure.

As described below, during use of the device 10 as an instructional aide, the base 12 is placed on the ground, with the major surface 16 facing upwardly, toward the user. To better stabilize the base 12 relative to the ground, in some embodiments, one or more securement features 22 are provided. The securement feature(s) 22 can assume a variety of forms; for example, the securement feature(s) 22 can be in the form of a hole 24 extending through a thickness of the base 12 as shown in FIGS. 1 and 2. The hole 24 is sized to allow passage of a conventional golf tee (not shown), with the tee head serving to secure the base 12 to the ground. Along these same lines, the hole 24 can be reinforced, for example with a grommet 26 or similar structure. General securement of the base 12 to the ground during use can be accomplished in other manners; alternatively, one or all of the securement features 22 can be eliminated.

The indicia 14 can convey various golf stance and/or swing instructional information, and generally includes a rear foot position indicator 30, one or more lead foot position indicators 32 (referenced generally), one or more ball placement indicators 34, and an optional target line indicator 36. As described below, the rear foot position indicator 30 visually conveys information relating to a desired position of a rear foot of a user, where as the lead foot position indicator(s) 32 each visually convey information relating to a desired position of the user's lead foot in conjunction with a particular shot to be performed by the user (as a point of reference, for a right-handed golfer, the golfer's right foot is the "rear foot" and the left foot is the "lead foot"). The ball placement indicator(s) 34 visually convey information relating to a desired position of a golf ball to be struck by the user. In this regard, the lead foot position indicators 32 and the ball placement indicators 34 are configured such that respective ones of the lead foot position indicators 32 correlate with corresponding ones of the ball placement indicators 34, for example in terms of color (it being understood that in the black and white illustration of FIGS. 1 and 2, differing line or dot patterns are employed to represent correlating colors). With this construction, a user can quickly identify the ball placement indicator 34 that corresponds with the selected lead foot position indicator 32 as described below. Finally, where provided, the target line indicator 36 visually conveys information relating to proper alignment of the user relative to an intended target.

The rear foot position indicator 30 includes, in some embodiments, a locational portion 40 and a written portion 42. The locational portion 40 is generally configured to convey a desired position and/or orientation of one of the user's feet. For example, in some embodiments, the locational portion 40 includes a primary line 44 and a secondary line 46. The lines 44, 46 intersect one another along a curvature 48 as shown, effectuating or approximating a curved, right angle. Further, the primary line 44 has a curvature representative of the outside curvature of a human foot in extension from the heel. The secondary line 46 also has a curvature opposite the intersection curvature 48, representative of a heel of a human foot. This construction creates a visual impression or representation of a human foot, with the primary line 44 being longer than the secondary line 46, thus immediately calling to mind that the user's foot should be positioned such that the heel is at or aligned with the secondary line 46, and oriented such that the toes extend in the direction of the primary line 44. The locational portion 40 can alternatively assume a variety of other constructions that create a similar visual effect. For example, one or both of the lines 44 and/or 46 can be linear. Alternatively, a full or partial picture of a foot or shoe can be used.

Regardless of the manner in which visual illustration of foot placement is conveyed by the locational portion 40, the resultant foot orientation dictated by the locational portion 40 corresponds with an orientation and location of the user's opposite or lead foot as otherwise provided by the selected lead foot position indicator 32 (where two or more of the lead foot indictors 32 are provided). Coordination between the indicators 30, 32 is described below. In general terms, however, the locational portion 40 can be described as establishing a known or desired foot orientation relative to a shape of the base 12. For example, the locational portion 40 is configured to visually instruct the user to position his or her rear foot such that the user's heel is generally parallel with the sides 18*a*, 18*b*, and extends in a generally parallel fashion relative to the ends 20*a*, 20*b*. In one embodiment, for example, the primary line 44 is positioned in close proximity to, and extends generally parallel with, the first end 20*a*, whereas the secondary line 46 is positioned in close proximity to, and extends generally parallel with, the second side 18*b*. As a point of reference, this construction is appropriate for a right-handed golfer, whereby placement of the user's right foot will be dictated by the locational portion 40; for left-handed applications, the locational portion 40 is formed in a mirror fashion proximate the second end 20*b*.

The written portion 42 includes one or more written words that explain which of the user's feet is to be aligned with the locational portion 40. In the one embodiment shown, the written portion 42 includes the words "RIGHT FOOT". A wide variety of other words (or word singular) can be used for the written portion 42, such as "RIGHT FOOT HERE" or "RIGHT". As a point of reference, these and other similar words, are appropriate for use of the teaching device 10 by a right-handed golfer; where the teaching device 10 is intended for use by a left-handed golfer, the written portion 42 will include one or more words instructing the user to place his or her left foot at the locational portion 40. While the written portion 42 is shown as being formed "within" the area defined by the locational portion 40, alternative positions relative to the locational portion 40 are equally acceptable (e.g., below, above, to the side, etc.). In yet other embodiments, the written portion 42 can be eliminated.

Regardless of exact form, the rear foot position indicator 30 is preferably formed of a singular color, or exhibits a readily discernable primary color (e.g., the lines 44, 46 can have a single colored central portion outlined by a different color). For example, in some embodiments, the rear foot position indicator 30 is entirely or primarily black, although other colors are also acceptable. As described below, regardless of the color selected, a primary color of the rear foot position indicator 30 is not only different from a primary color of the major surface 16 of the base 12, but is also different from any of the primary colors associated with the lead foot position indicators 32 and the ball placement indicators 34.

The lead foot position indicator(s) 32 are adapted to identify a proper position of the user's opposite foot relative to the user's first foot (that is otherwise positioned in accordance with the rear foot position indicator 30) in performing a shot (where only one of the lead foot position indicators 32 is provided) or one of a plurality of different shots (where a plurality of the lead foot position indicators 32 are provided). With the one embodiment shown, the lead foot position indicators 32 include first—fourth shot specific identifiers 50*a*-50*d*, although more or less than four of the identifiers can be provided. The shot specific identifiers 50*a*-50*d* are, in many respects, similar such that the following description of the first shot specific identifier 50*a* is equally applicable to the other identifiers 50*b*-50*d*. It will be understood, however, that each shot specific identifier 50*a*-50*d* relates to a different golf shot to be performed by a user. For example, the first shot specific identifier 50*a* relates to a "chip" shot, and thus instructs as to proper lead foot placement and orientation (e.g., the user's left foot) relative to the rear foot position indicator 30 in performing the chip shot; the fourth shot specific identifier 50*d* relates to a "drive," and thus instructs as to proper lead foot placement and orientation in performing a drive; etc.

With the above in mind, the first shot specific identifier 50*a* includes, in some embodiments, a locational portion 60*a* and a written portion 62*a*. The locational portion 60*a* is akin to the locational portion 40 described above, and is generally configured to convey a desired position and/or orientation of the user's lead foot. For example, in some embodiments, the locational portion 60*a* includes a primary line 64*a* and a secondary line 66*a*. The lines 64*a*, 66*a* intersect one another along a curvature 68*a* as shown, effectuating or approximating a curved right angle. This construction creates a visual representation of a human foot, with the primary line 64*a* being longer than the secondary line 66*a*, thus immediately calling to mind that the user's lead foot should be positioned such that the heel is at or aligned with the secondary line 66*a*, and oriented such that the toes extend in the direction of the primary line 64*a*. The locational portion 60*a* can alternatively assume a variety of other constructions that create a similar visual effect as described above.

Regardless of the manner in which visual illustration of foot placement is conveyed by the locational portion 60*a*, the resultant foot orientation dictated by the locational portion 60*a* corresponds with an orientation and location of the user's rear foot as otherwise provided by the rear foot position indicator 30, and is specific to a desired shot. Thus, where the first shot specific identifier 50*a* is intended to instruct a user in performing a chip shot, the locational portion 60*a* is configured to position the user's corresponding lead foot (i.e., the left foot of a right-handed golfer) fairly close to, slightly below, and in an "open" orientation (or "open stance") relative to the user's rear foot that is otherwise aligned with the rear foot position indicator 30. For example, the locational portion 60*a* can be arranged such that the secondary line 66*a* is "below" the secondary line 46 of the rear foot position indicator 30 (e.g., closer to the second side 18*b* of the base 12). Further, the primary line 64*a* extends in a non-parallel manner relative to the primary line 44 of the rear foot position indicator 30; more particularly, diverging from the primary line 44 in extension from the secondary line 66*a* (as compared to extension of the primary line 44 from the secondary line 46 of the rear foot position indicator 30). This orientation and position corresponds with the generally accepted golf stance for performing a chip shot. Where a different shot (i.e., other than a chip shot) is intended to be implicated by the first shot specific identifier 50*a*, the placement and/or orientation information conveyed by the locational portion 60*a* will assume a different, corresponding form.

The written portion 62*a* includes one or more written words that explain the type of shot associated with first shot specific identifier 50*a*. In the one embodiment shown, the written portion 62*a* includes the word "CHIP". A wide variety of other words (or word singular) can be used for the written portion 62*a*, such as "SHORT" or "9 IRON". Further, the written portion 62*a* can include information describing which of the user's feet is to be placed on or by the locational portion 60*a* (e.g., can include the word "left"). While the written portion 62*a* is shown as being formed "within" the area defined by the locational portion 60*a*, alternative positions relative to the locational portion 60*a* are equally acceptable (e.g., below, above, to the side, etc.).

Regardless of exact form, the first shot specific identifier 50*a* is preferably formed of a singular color, or exhibits a readily discernable primary color (e.g., the lines 64*a*, 66*a* can have a single colored central portion outlined by one or more different colors). For example, in some embodiments, the first shot specific identifier 50*a* (including both the locational portion 60*a* and the written portion 62*a*) is entirely or primarily yellow, although other colors are also acceptable. As a point of reference, the use of a diamond line pattern for the locational portion 60*a* in FIGS. 1 and 2 is for clarification purposes only in better distinguishing the locational portion 60*a* from other portions of the indicia 14; in actual practice, the locational portion 60*a* will be distinguishable from other portions of the indicia 14 based on color. As described below, regardless of the color selected, a primary color of the first shot specific identifier 50*a* is not only different from a primary color of the major surface 16 of the base 12, but is also different from any of the primary colors associated with the rear foot indicator 30, the other shot specific identifiers 50*b*-50*d*, and all but one of the ball placement indicators 34.

The remaining shot specific identifiers 50*b*-50*d* are similar in form to the first shot specific identifier 50*a* as described above, but provide foot placement information corresponding to a different, particular shot. For example, the second shot specific identifier 50*b* includes a locational portion 60*b* and a written portion 62*b*, and is configured to dictate lead foot placement (relative to the rear foot position indicator 30) for a putt. The locational portion 60*b* can include primary and secondary lines 64*b*, 66*b* akin to those described above. As compared to the first shot specific identifier 50*a*, the locational portion 60*b* is further spaced from the locational portion 40 of the rear foot position indicator 30, the primary lines 44, 64*b* are generally parallel with one another, and the secondary lines 46, 66*b* are generally aligned. The written portion 62*b* includes one or more words indicative of the shot selection implicated by the second shot specific identifier 50*b*. Thus, for example, the written portion 62*b* can include the word "PUTT" as shown, or other similar word(s) such as "PUTTER" or "GREEN".

Regardless of exact form, the second shot specific identifier 50*b* is preferably formed of a singular color, or exhibits a readily discernable primary color (e.g., the lines 64*b*, 66*b* can have a single colored central portion outlined by one or more different colors). Once again, the use of dots for the locational portion 60*b* in FIGS. 1 and 2 is for clarification purposes; in actual practice, the locational portion 60*b* will be a continuous illustration/line of a single, primary color. For example, in some embodiments, the second shot specific identifier 50*b* (including both the locational portion 60*b* and the written portion 62*b*) is entirely or primarily white, although other colors are also acceptable. As described below, regardless of the color selected, a primary color of the second shot specific identifier 50*b* is not only different from a primary color of the major surface 16 of the base 12, but is also different from any of the primary colors associated with the rear foot position indicator 30, the other shot specific identifiers 50*a*, 50*c*, 50*d*, and all but one of the ball placement indicators 34.

The third shot specific identifier 50*c* includes a locational portion 60*c* and a written portion 62*c*, and is configured to dictate lead foot placement (relative to the rear foot position indicator 30) for an iron or pitch shot. The locational portion 60*c* can include primary and secondary lines 64*c*, 66*c* akin to that described above. As compared to the first and second shot specific identifiers 50*a*, 50*b*, the locational portion 60*c* is further spaced from the locational portion 40 of the rear foot position indicator 30. The secondary line 66*c* is slightly "below" (i.e., closer to the second side 18*b*) the secondary line 46, and the primary lines 64*c* extends (from the secondary line 66*c*) in a non-parallel fashion relative to an orientation of the primary line 46 to define a slightly "open" stance. The written portion 62*c* includes one or more words indicative of the shot selection implicated by the third shot specific identifier 50*c*. Thus, for example, the written portion 62*c* can include the words "IRON & PITCH" as shown, or other similar word(s) such as "PITCH" or "LOB" or "WEDGE".

Regardless of exact form, the third shot specific identifier 50*c* is preferably formed of a singular color, or exhibits a readily discernable primary color (e.g., the lines 64*c*, 66*c* can have a single colored central portion outlined by one or more different colors). Once again, the use of vertical lines for the locational portion 60*c* in FIGS. 1 and 2 is for clarification purposes; in actual practice, the locational portion 60*c* will be a continuous illustration/line of a single, primary color. For example, in some embodiments, the third shot specific identifier 50*c* (including both the locational portion 60*c* and the written portion 62*c*) is entirely or primarily red, although other colors are also acceptable. As described below, regardless of the color selected, a primary color of the third shot specific identifier 50*c* is not only different from a primary color of the major surface 16 of the base 12, but is also different from any of the primary colors associated with the rear foot position indicator 30, the other shot specific identifiers 50*a*, 50*b*, 50*d*, and all but one of the ball placement indicators 34.

The fourth shot specific identifier 50*d* includes a locational portion 60*d* and a written portion 62*d*, and is configured to dictate lead foot placement (relative to the rear foot position indicator 30) for a drive (e.g., using a wood or similar club). The locational portion 60*d* can include primary and secondary lines 64*d*, 66*d* akin to that described above. As compared to the first—third shot specific identifiers 50*a*-50*c*, the locational portion 60*d* is further spaced from the locational portion 40 of the rear foot position indicator 30. The secondary line 66*d* is slightly "below" (i.e., closer to the second side 18*b*) the secondary line 46, and the primary lines 64*d* extends (from the secondary line 66*d*) in a non-parallel fashion relative to an orientation of the primary line 46 to define a slightly "open" stance. The written portion 62*d* includes one or more words indicative of the shot selection implicated by the fourth shot specific identifier 50*d*. Thus, for example, the written portion 62*d* can include the word "DRIVE" as shown, or other similar word(s) such as "DRIVER" or "WOOD".

Regardless of exact form, the fourth shot specific identifier 50*d* is preferably formed of a singular color, or exhibits a readily discernable primary color (e.g., the lines 64*d*, 66*d* can have a single colored central portion outlined by one or more different colors). Once again, the use of horizontal lines for the locational portion 60*d* in FIGS. 1 and 2 is for clarification purposes; in actual practice, the locational portion 60*d* will be a continuous illustration/line of a single, primary color. For example, in some embodiments, the fourth shot specific identifier 50*d* (including both the locational portion 60*d* and the written portion 62*d*) is entirely or primarily blue, although other colors are also acceptable. As described below, regardless of the color selected, a primary color of the fourth shot specific identifier 50*d* is not only different from a primary color of the major surface 16 of the base 12, but is also different from any of the primary colors associated with the rear foot position indicator 30, the other shot specific identifiers 50*a*-50*c*, and all but one of the ball placement indicators 34.

The ball placement indicators 34 are adapted to identify a proper position of a golf ball to be struck by the user in performing one of a plurality of different shots with his or her feet positioned in accordance with the locations designated by the rear foot position indicator 30 and the selected one of the lead foot position indicators 32. With the one embodiment shown, four ball placement indicators 34*a*-34*d* are provided, commensurate with the number of lead foot position indicators 32. Thus, in other embodiments, more or less than four of the ball placement indicators 34 can be provided.

In general terms, the ball placement indicators 34*a*-34*d* are formed adjacent the first side 18*a* of the base 12, and are generally identical in shape or format. For example, the ball placement indicators 34*a*-34*d* can have the shape of circle (thus creating the visual effect of a golf ball). Alternatively, the ball placement indicators 34*a*-34*d* can assume other shapes and/or can include written words or symbols that otherwise implicate placement of a golf ball.

Respective ones of the ball placement indicators 34*a*-34*d* correlate with respective ones of the shot specific identifiers 50*a*-50*d*. For example, the first ball placement indicator 34*a* is associated with the first shot specific identifier 50*a*, and dictates a proper location of a golf ball relative to a user whom is otherwise performing the shot indicated by the first shot specific identifier 50*a* (and has or will be placing his or her feet at the locations and orientations dictated by the rear foot position indicator 30 and the first shot specific identifier 50*a*). Thus, in one embodiment, the first ball placement indicator 34*a* identifies a proper location of a golf ball relative to a user when performing a chip shot, relative to the user's stance as dictated by the rear foot position indicator 30 and the first shot specific identifier 50*a*. To immediately visually convey the association between the first ball placement indicator 34*a* and the first shot specific identifier 50*a*, the first ball placement indicator 34*a* is preferably formed of a singular color, or exhibits a readily discernable primary color, that is identical with the primary color of the first shot specific identifier 50*a*. For example, in some embodiments, the first ball placement indicator 34*a* is entirely or primarily yellow, although other colors are also acceptable so long as a visual color match with the first shot specific identifier 50*a* is established. Thus, a primary color of the first ball placement indicator 34*a* is not only different from a primary color of the major surface 16 of the base 12, but is also different from any of the primary colors associated with the rear foot position indicator 30, the other ball placement indicators 34*b*-34*d*, and all but one of the shot specific identifiers 50*a*-50*d*. To clarify this color correlation, FIGS. 1 and 2 represents the first ball placement indicator 34*a* with a diamond line pattern identical to the representation of the first shot specific identifier 50*a*; in actual practice, the first ball placement indicator 34*a* and the first shot specific identifier 50*a* will be continuous illustrations/bodies of a single, primary color.

The second ball placement indicator 34*b* is associated with the second shot specific identifier 50*b*, and dictates a proper location of a golf ball relative to a user whom is otherwise performing the shot indicated by the second shot specific identifier 50*b* (and has or will be placing his or her feet at the locations and orientations dictated by the rear foot position indicator 30 and the second shot specific identifier 50*b*). Thus, in one embodiment, the second ball placement indicator 34*b* identifies a proper location of a golf ball relative to a user when performing a putt, relative to the user's stance as dictated by the rear foot position indicator 30 and the second shot specific identifier 50*b*. To immediately visually convey the association between the second ball placement indicator 34*b* and the second shot specific identifier 50*b*, the second ball placement indicator 34*b* is preferably formed of a singular color, or exhibits a readily discernable primary color that is identical with the primary color of the second shot specific identifier 50*b* (again, the dots employed in FIGS. 1 and 2 for the second ball placement indicator 34*b* are for clarification purposes only to represent a visual correlation with the second shot specific identifier 50*b*). For example, in some embodiments, the second ball placement indicator 34*b* is entirely or primarily white, although other colors are also acceptable so long as a visual color match with the second shot specific identifier 50*b* is established. Thus, a primary color of the second ball placement indicator 34*b* is not only different from a primary color of the major surface 16 of the base 12, but is also different from any of the primary colors associated with the rear foot position indicator 30, the other ball placement indicators 34*a*, 34*c*, 34*d*, and all but one of the shot specific identifiers 50*a*-50*d*.

The third ball placement indicator 34*c* is associated with the third shot specific identifier 50*c*, and dictates a proper location of a golf ball relative to a user whom is otherwise performing the shot indicated by the third shot specific identifier 50*c* (and has or will be placing his or her feet at the locations and orientations dictated by the rear foot position indicator 30 and the third shot specific identifier 50*c*). Thus, in one embodiment, the third ball placement indicator 34*c* identifies a proper location of a golf ball relative to a user when performing an iron or pitch shot, relative to the user's stance as dictated by the rear foot position indicator 30 and the third shot specific identifier 50*c*. In some embodiments, zone markings 70*a*, 70*b* can optionally be provided at opposite sides of the third ball placement indicator 34*c*. The zone markings 70*a*, 70*b* assist a user in best positioning a golf ball for various iron shots. In particular, the zone markings 70*a* forward (e.g., to the left in FIGS. 1 and 2) of the third ball indicator 34*c* are for increasingly longer iron shots (e.g., 2-4 irons), whereas the zone markings 70*b* rearward (e.g., to the right in FIGS. 1 and 2) are increasingly shorter iron shots (e.g., 8 iron-pitching wedge). Thus, for example, the zone markings 70*a*, 70*b* visually instruct a user to place a golf ball for a longer iron shot forward of the third ball placement indicator 34*c*.

To immediately visually convey the association between the third ball placement indicator 34*c* (and the zone markings 70*a*, 70*b* where provided) and the third shot specific identifier 50*c*, the third ball placement indicator 34*c* (and the zone markings 70*a*, 70*b* where provided) is preferably formed of a singular color, or exhibits a readily discernable primary color that is identical with the primary color of the third shot specific identifier 50*c*. Once again, the vertical lines employed in FIGS. 1 and 2 for the third ball placement indicator 34*c* are for clarification purposes only to represent a visual correlation with the third shot specific identifier 50*c*. For example, in some embodiments, the third ball placement indicator 34*c* (and the zone markings 70*a*, 70*b* where provided) is entirely or primarily red, although other colors are also acceptable so long as a visual color match with the third shot specific identifier 50*c* is established. Thus, a primary color of the third ball placement indicator 34*c* (and the zone markings 70*a*, 70*b* where provided) is not only different from a primary color of the major surface 16 of the base 12, but is also different from any of the primary colors associated with the rear foot position indicator 30, the other ball placement indicators 34*a*, 34*b*, 34*d*, and all but one of the shot specific identifiers 50*a*-50*d*.

The fourth ball placement indicator 34*d* is associated with the fourth shot specific identifier 50*d*, and dictates a proper location of a golf ball relative to a user whom is otherwise performing the shot indicated by the fourth shot specific identifier 50*d* (and has or will be placing his or her feet at the locations and orientations dictated by the rear foot position indicator 30 and the fourth shot specific identifier 50*d*). Thus, in one embodiment, the fourth ball placement indicator 34*d* identifies a proper location of a golf ball relative to a user when performing a drive shot, relative to the user's stance as dictated by the rear foot position indicator 30 and the fourth shot specific identifier 50*d*. To immediately visually convey the association between the fourth ball placement indicator 34*d* and the fourth shot specific identifier 50*d*, the fourth ball placement indicator 34*d* is preferably formed of a singular color, or exhibits a readily discernable primary color that is identical with the primary color of the fourth shot specific identifier 50*d* (again, the horizontal lines employed in FIGS. 1 and 2 for the fourth ball placement indicator 34*d* are for clarification purposes only to represent a visual correlation with the fourth shot specific identifier 50*d*). For example, in some embodiments, the fourth ball placement indicator 34*d* is entirely or primarily blue, although other colors are also acceptable so long as a visual color match with the fourth shot specific identifier 50*d* is established. Thus, a primary color of the fourth ball placement indicator 34*d* is not only different from a primary color of the major surface 16 of the base 12, but is also different from any of the primary colors associated with the rear foot position indicator 30, the other ball placement indicators 34*a*-34*c*, and all but one of the shot specific identifiers 50*a*-50*d*.

Finally, where provided, the target line indicator 36 provides general visual guidance or sub-conscious "feel" to a user as to how he or she should be facing relative to an intended target. Further, the target line indicator 36 can visually guide a user as to proper shoulder and hip alignment prior to swinging (e.g., parallel to the target line indicator 36). In some embodiments, the target line indicator 36 is simply a linear, wide stripe extending at, and/or parallel with, the first side 18*a* of the base 12. Other formats are also acceptable, and can include, for example, an arrow head, one or more words, etc. Regardless, the primary color of the target line indicator 36 is different from the primary colors associated with the lead foot position indicators 32 and the ball placement indicators 34, as well as the primary color of the major surface 16. In other embodiments, the target line indicator 36 can be eliminated.

As a point of reference, while the indicia 14 has been described and shown in FIGS. 1 and 2 in connection with a right-handed golfer, the teaching device 10 is equally applicable for use by a left-handed golfer. For left-handed applications, the rear and lead foot position indicators 30, 32 and the ball placement indicators 34 are essentially reversed (or presented as a mirror image to that illustrated in FIGS. 1 and 2). In some embodiments, the indicia 14 can be printed on both major surfaces of the base 12, with the indicia 14 on one surface being directed toward a right-handed golfer, and the indicia 14 on the opposite surface being directed toward a left-handed golfer. With this alternative approach, additional printed indicia can be included, explaining to the user which surface should be used (e.g., the words "Right Handed" can appear on one surface, and the words "Left Handed" can appear on the opposite surface).

During use, a user intending to practice one or more golf shots lays the teaching device 10 on the ground, with the major surface 16 facing upwardly. Where the teaching device 10 includes the target line indicator 36, the base 12 is arranged such that the target line indicator 36 is parallel to the direction of the intended target. The base 12 can then be secured to the ground, for example by inserting tees through the holes 24. Regardless, the user then selects a particular shot he or she would like to practice, and retrieves the appropriate club. With the selected shot in mind, the user views the indicia 14 and identifies the corresponding shot specific identifier 50. For example, where the user intends to perform a pitch shot, the third shot specific identifier 50*c* is highlighted by the user, for example via the written portion 62*c*. The ball placement indicator 34 corresponding with the identified shot specific identifier 50 is then located, based upon a match between the primary color of the identified shot specific identifier 50 and the corresponding ball placement indicator 34. Continuing with the above example, then, a user intending to perform a pitch shot will readily recognize a match between the primary color of the third shot specific identifier 50*c* and the third ball placement indicator 34*c*.

The user then positions a golf ball in general alignment with the identified ball placement indicator 34. Depending upon a size of the base 12 and a height of the user, the golf ball will be placed close to or spaced from the first side 18*a* of the base 12; in other embodiments, the golf ball can be placed directly on the identified ball placement indicator 34. Regardless, alignment between the golf ball and the identified ball placement indicator 34 relates to an imaginary line extending from the identified ball placement indicator 34 in a direction perpendicular to the first side 18*a*. Continuing the above example, then, a user intending to perform a pitch shot will place the golf ball in alignment with the zone markings 70*b* associated with the third ball placement indicator 34*c*.

The user then positions his or her rear foot (e.g., right foot for a right-handed golfer) on the rear foot position indicator 30, and his or her lead foot (e.g., left foot for a right-handed golfer) on the identified shot specific identifier 50. Location and orientation of the user's rear foot is dictated by the locational portion 40 of the rear foot position indicator 30 as described above. Similarly, the locational portion 60 of the selected shot specific identifier 50 dictates a location and orientation of the user's lead foot. Continuing the above example and relative to a right-handed golfer, the user's right foot is placed on the locational portion 40 such that the heel of the right foot is on or adjacent the secondary line 46, and the right foot is generally oriented to be along the primary line 44. The user's left foot is placed on the locational portion 60*c* of the third shot specific identifier 50*c* such that the heel of the left foot is on or adjacent the secondary line 66*c*, and the left foot is generally oriented to be along the primary line 64*c*.

With the user's feet positioned as described above, the user can then evaluate whether the previously positioned golf ball is at a comfortable distance. Where necessary, the golf ball can be moved closer to, or away from, the base 12. Once comfortable, the user then performs the selected shot.

While the above description includes the user standing directly upon the base 12, in other embodiments, the user's feet need not be on the base 12 itself. Instead, depending upon a size of the base 12 and/or a height of the user, the user may feel more comfortable standing away from the teaching device 10. Under these circumstances, the rear foot position indicator 30 and the selected lead foot position indicator 32 provides the user with general guidance as to foot placement and orientation, and the identified ball placement indicator 34 advices the user as to where the golf ball is properly placed relative to the user's stance.

Following use, the teaching device 10 is simply carried away by the user. Where the base 12 is in the form of a cloth towel, the teaching device 10 can be cleaned (e.g., washing machine), and can be used for other activities, such as a conventional golf towel.

Although the present disclosure has been described with reference to preferred embodiments, workers skilled in the art will recognize that changes can be made in form and detail without departing from the spirit and scope of the present disclosure. For example, while the golf shot set-up and ball placement training device has been described as including multiple lead foot position and ball placement indicators indicative of different, disparate golf shots (e.g., drive, chip, putt, etc.), in other embodiments, only a single golf shot is implicated. For example, the training device can include a single lead foot position indicator and a single ball placement indicator, along with nomenclature reflecting the shot to be performed while using the device. Thus, for example, the training device can be a "putting" teaching aide, a "chipping" teaching aide, a "driving" teaching aide, etc.

What is claimed is:

1. A golf teaching device comprising:

a cloth towel having first and second opposing major surfaces; and indicia printed on one of the major surface and including:

a single rear foot position indicator adapted to indicate a proper position and orientation of a user's rear foot, a plurality of lead foot position indicators adapted to indicate a proper position and orientation of a user's lead foot in performing one of a plurality of different golf shots and including:

a first shot specific identifier, a second shot specific identifier spaced from the first shot specific identifier, first and second ball placement indicators adapted to indicate a proper location of a golf ball to be struck by a user, wherein the first shot specific identifier and the first ball placement indicator have an identical, first primary color, and the second shot specific identifier and the second ball placement indicator have an identical, second primary color, the first and second primary colors being different; and wherein the indicia further includes zone markings associated with the second ball placement indicator.

2. The teaching device of claim 1, wherein the first shot specific identifier relates to a chip shot and the second shot specific identifier relates to a putt shot.

3. The teaching device of claim 1, wherein the rear foot position indicator and the plurality of lead foot position indicators each include a locational portion visually representing an outside curvature of the human foot.

4. The teaching device of claim 3, wherein a spatial arrangement of the locational portion of the first shot specific identifier relative to the first ball placement indicator is different from a spatial arrangement of the locational portion of the second shot specific identifier relative to the second ball placement indicator.

5. The teaching device of claim 3, wherein each of the lead foot position indicators further include a written portion.

6. The teaching device of claim 5, wherein the written portion of the rear foot position indicator identifies a foot to be placed at the corresponding locational portion.

7. The teaching device of claim 1, wherein the ball placement indicators are aligned relative to an edge of the towel.

8. The teaching device of claim 1, wherein the indicia further includes:

a third shot specific identifier spaced from the first and second shot specific identifiers; and a third ball placement indicator;

wherein the third shot specific identifier and the third ball placement indicator have an identical, third primary color differing from the first and second primary colors.

9. The teaching device of claim 8, wherein the indicia further includes:

a fourth shot specific identifier spaced from the first, second, and third shot specific identifier; and a fourth ball placement indicator;

wherein the fourth shot specific identifier and the fourth ball placement indicator have an identical, fourth primary color differing from the first, second, and third primary colors.

10. The teaching device of claim 9, wherein the first shot specific identifier relates to a chip shot, the second shot specific identifier relates to a putt shot, the third shot specific identifier relates to a pitch shot, and the fourth shot specific identifier relates to a drive shot.

11. The teaching device of claim 9, wherein the rear foot position indicator has a fifth primary color, the fifth primary color differing from the first, second, third, and fourth primary colors.

12. The teaching device of claim 1, wherein the indicia further includes:

a target line indicator extending parallel with a side of the towel.

13. The teaching device of claim 12, wherein the first and second ball placement indicators are formed within the target line indicator.

14. The teaching device of claim 1, wherein the towel forms a hole through a thickness thereof for receiving a securement device to secure the towel to ground.

15. A method of aiding a golfer in preparing to perform a golf shot, the method comprising:

providing a golf teaching device including:

a cloth towel having first and second opposing major surfaces;

indicia printed on one of the major surface and including:

a single rear foot position indicator adapted to indicate a proper position and orientation of a user's rear foot, a plurality of lead foot position indicators adapted to indicate a proper position and orientation of a user's lead foot in performing one of a plurality of different golf shots and including:

a first shot specific identifier, a second shot specific identifier spaced from the first shot specific identifier, first and second ball placement indicators adapted to indicate a proper location of a golf ball to be struck by a user, wherein the first shot specific identifier and the first ball placement indicator have an identical, first primary color, and the second shot specific identifier and the second ball placement indicator have an identical, second primary color, the first and second primary colors being different; wherein the indicia further includes zone markings associated with the second ball placement indicator;

selecting one of the lead foot position indicators corresponding with a golf shot desired by the golfer;

visually matching the selected lead foot position indicator with the corresponding ball placement indicator;

placing a golf ball adjacent the matched ball placement indicator;

placing a rear foot of the golfer on the rear foot position indicator at an orientation instructed by the rear foot position indicator; and placing a lead foot of the golfer on the selected lead foot position indicator.

16. The method of claim 15, wherein the indicia further includes:

a third shot specific identifier;

a third ball placement indicator;

wherein the third shot specific identifier and the third ball placement indicator have an identical third, primary color;

a fourth shot specific identifier; and a fourth ball placement indicator;

wherein the fourth shot specific identifier and the fourth ball placement indicator have an identical fourth primary color.

17. The method of claim 15, wherein the desired shot is selected from the group consisting of a drive and a putt.

18. The method of claim 15, further comprising:

a. performing a golf swing following placing of the rear foot and the lead foot;

b. cleaning the teaching device in a washing machine; and c. using the washed golf teaching device to aid a golfer in preparing to perform a golf swing with reference to the indicia.

19. The method of claim 15, wherein the indicia further includes a target line indicator extending parallel with a side of the towel, the method further comprising:

aligning shoulders and hips of the golfer parallel with the target line indicator following placing of the lead foot and the rear foot.

* * * * *